United States Patent [19]

Lumsden

[11] 3,985,456

[45] Oct. 12, 1976

[54] CALLIGRAPHIC DEVICE FOR ARTISTS OR THE LIKE

[76] Inventor: Angus Lumsden, 25 Waverly St., Glen Head, N.Y. 11545

[22] Filed: Apr. 7, 1975

[21] Appl. No.: 565,809

[52] U.S. Cl. ..... 401/145; 401/176; 401/265

[51] Int. Cl.[2] ..... B43K 5/04

[58] Field of Search ..... 401/176–182, 401/187, 188, 145, 265; 222/92, 95, 209, 386.5, 389, 409; 92/98 R, 98 D

[56] References Cited

UNITED STATES PATENTS

| | | | |
|---|---|---|---|
| 2,652,949 | 9/1953 | Martin | 222/95 |
| 3,199,511 | 8/1965 | Kulick | 222/386.5 X |
| 3,235,138 | 2/1966 | Bull | 222/386.5 |
| 3,483,800 | 12/1969 | Golden | 92/98 R X |
| 3,871,553 | 3/1975 | Steinberg | 222/95 |

*Primary Examiner*—Lawrence Charles

[57] ABSTRACT

This disclosure relates to a calligraphic device for artists and craftsman or the like and includes a device whereupon the user can conveniently manuever and control such a device for producing fine lineaments for ornamental or practical features. The apparatus comprises a nozzle device through which a viscose liquid can be controllably fed by means of a hydraulic piston and cylinder arrangement acting on a flexible chamber in the nozzle device. The novel arrangement permits the user substantially full control over the nozzle while feeding the liquid so as to deposit smooth lines of desired thickness and form without over or under feeding.

6 Claims, 6 Drawing Figures

10
12
13
14
16
18
20
22
24
26
28
30
32
34
36
40
42
48
52
54
56
58
60
62
64
68
70
72
74
76
78
80
82

CALLIGRAPHIC DEVICE FOR ARTISTS OR THE LIKE

GENERAL DESCRIPTION OF THE INVENTION

The present invention relates to calligraphic devices or devices for manually producing three dimensional lines in drawings or paintings and the like. Such devices are often used by artists and others in various fields but often with some difficulty as such devices used in the past required that the hand which guides the orifice or nozzle must also apply the pressure for feeding the viscose liquid. This type of device causes the liquid to flow in a non-uniform manner, is difficult to use for making fine lines, the starting and stopping of the flow is difficult to control and the resulting lines or ornamentation produced is generally irregular, coarse and imprecise.

In the present invention the nozzle device may be held in the hand applying the lineament while the other hand is used for applying controlled pressure to the liquid. The liquid is stored in a flexible chamber, open at its outlet end which chamber is in turn disposed in a cylinder in which fluid pressure acting on the flexible chamber may be varied. In order to vary the pressure in the nozzle cylinder a piston is disposed in a pressure cylinder between which piston and cylinder there is provided a flexible member. The flexible member is sealed at one outer end of the pressure cylinder and surrounds the piston so that, as the piston moves up and down in the pressure cylinder, the flexible member expands or contracts to vary the pressure in said cylinder. The bottom of the pressure cylinder is connected to the nozzle cylinder by means of a flexible tube to transmit the variations in pressure to the nozzle.

In order to manually vary the pressure in the pressure cylinder, a control lever is connected to the piston by means of a pivoted connecting rod. The control lever has a pivot support at one end and a long handle at its opposite end for convenience of the user. A holding mechanism is also operatively connected with the control lever to stop the continued application of pressure to the liquid at a desired position when the artist has completed a desired lineament. The operation of the control lever and holding mechanism is such that a negative pressure occurs during a holding position so as to prevent drippage or overflow of the liquid. Thus, as will be apparent hereinafter the novel device of the invention permits the artist or user to deposit the lineament in a controlled manner with one hand while controlling the flow of the medium with the other hand.

Accordingly, it is one object of the invention to provide a novel and improved tool for depositing a lineament.

It is another object of the invention to provide a novel and improved calligraphy device.

It is a further object of the invention to provide a novel and improved device for manually depositing a viscose medium in a controlled manner.

It is also an object of the invention to provide a novel and improved artist tool having improved control for starting and stopping the flow of a viscose medium for depositing a lineament.

Other objects and advantages of the invention will become apparent upon reading the following detailed description of the invention with the accompanying drawings in which.

DETAILED DESCRIPTION OF THE INVENTION

Figures 1, 6:
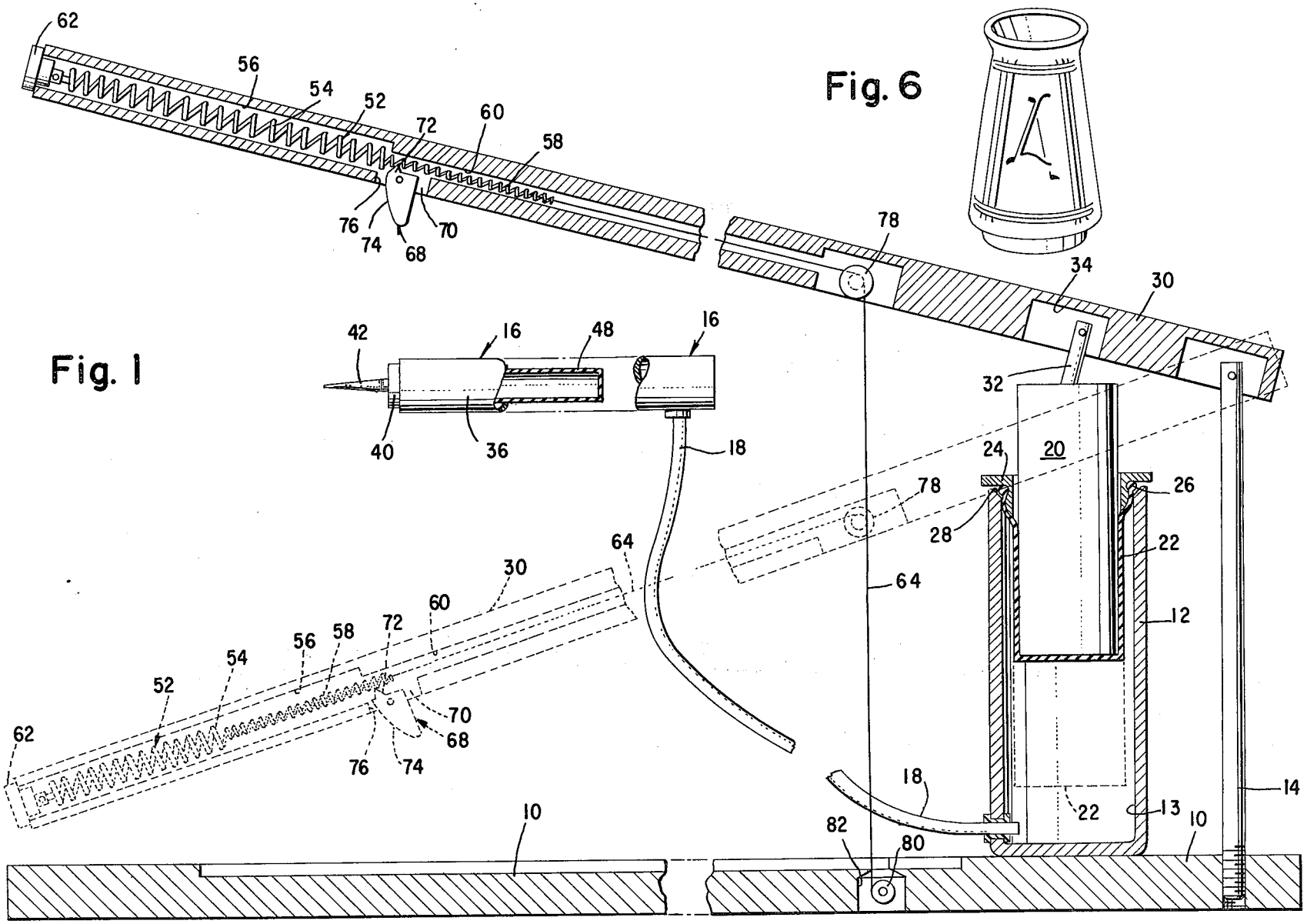
FIG. 1 is a cross sectional view of the present invention.
FIG. 6 is an elevational view of a ceramic work having ornamentation placed thereon by use of the present invention.

Referring now to FIG. 1, a calligraphic apparatus is shown therein comprising a base 10 which has supported thereon a cylinder 12 and a control lever support rod 14. A nozzle device 16 is connected to the cylinder 12 at its base by means of a flexible tube 18 which is also connected to the base of the nozzle device 16, as illustrated. The tube 18 is sealed through suitble well-known means where it connects with the cylinder 12 and nozzle device 16 as through a rubber grommet or the like. The cylinder 12 is suitably supported on the base 10 as by means of screws, or by other suitable means. Also, the support rod 14 is supported in the base 10 in any suitable manner, as by means of thread on the support rod 14 and a tap in the base 10, as illustrated.

Figure 2:
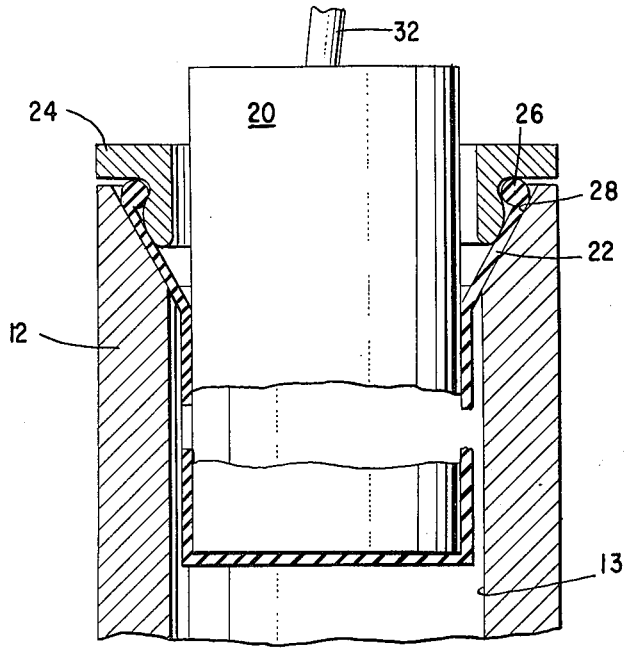
FIG. 2 is an enlarged cross sectional view of a portion of the pressure cylinder device of the present invention.

In FIGS. 1 and 2, the cylinder 12 is shown as having a piston 20 disposed therein with the outer diameter of the piston being less than that of the inner diameter of the cylinder 12 so as to accomodate a flexible elastic member 22. The member 22 surrounds the lower portion of the piston 20 and is preferably made of an elastic material such as rubber or latex so that it substantially elastically surrounds the piston at its lower end portion as the piston presses thereon. At its outer circumference the member 22 is supported by an annular member 24 which has a channel 26 therein for receiving the bead-like outer circumferential portion 26 of the member 22. The cylinder 12 has a sloping inner surface 28 at its upper and inner surface portion for receiving the annular member 24 and in particular receives the bead 26 in contacting engagement when the annular member 24 is inserted into the cylinder 12 with the flexible member 22 supported thereon. As will be appreciated, when the annular member is inserted into the cylinder 12 the bead 26 will roll into a substantially tight fitting engagement with the surface 28 so that the hollow interior or chamber 13 of the cylinder 12 will be sealed at its outer end. The greater the pressure exerted on the flexible member 22 by the piston 20 the greater will be the pressure at the sealing engagement between the bead 24 and the surface 28.

In order to actuate the piston 20 a control lever 30 is provided which is pivotally mounted at one end on the support rod 14. A connecting rod 32 is pivotally supported, at one end on the piston in a known manner (not shown) and at its other end on a pin in a slot 34 formed in the control lever 30. It will be seen, therefore, that, as the control lever is raised or lowered, the piston 20 will be correspondingly raised or lowered and exert pressure on the flexible member 22, which acts much in the nature of a diaphragm, to vary the pressure in the cylinder chamber 13 and thus the pressure in tube 18 and consequently within nozzle 16.

Figure 3:
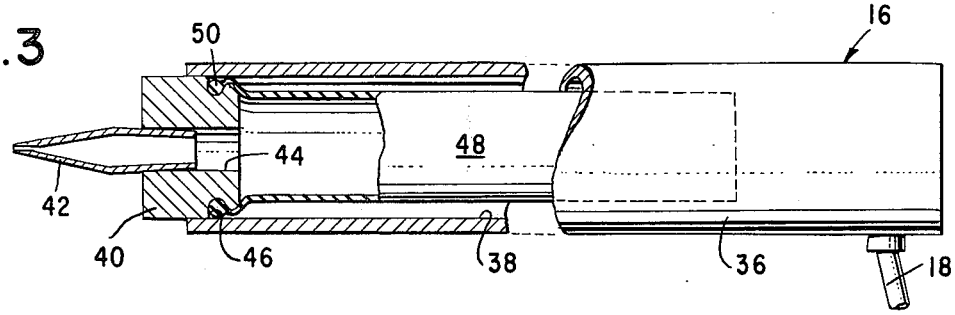
FIG. 3 is an enlarged partial cross sectional view of the nozzle device of the invention.

With reference to FIG. 3, the nozzle device 16 to which the tube 18 is connected comprises a nozzle cylinder 36 having a hollow interior or chamber 38. A stopper 40 is removably supported in the open end of nozzle cylinder 36 and is provided with a nozzle member 42 disposed in a hole 44 in said stopper 40. The stopper 40 is provided with an annular groove 46 adjacent the end disposed in the chamber 38 and receives an elastic tube-like member 48 thereon. The member 48 is provided with a bead-like outer end 50 which fits into the annular groove 46 in sealing engagement therewith. The tube-like member 48 is made from an elastic material such as rubber or latex and has for its main function the storage of the viscose medium to be deposited by the nozzle member 42. It will be apparent from the structure so far described that, if the control lever 30 is lowered the piston 20 will also be lowered thereby exerting a downward pressure on flexible member 22 which in turn will exert a fluid pressure increase in the chamber 13. This increase in pressure in chamber 13 is communicated by means of tube 18 to the hollow nozzle chamber 28, which is sealed, so that a fluid pressure is exerted on the tube-like member 48 containing the viscose medium thereby causing said medium to flow out of the nozzle member 42 at a rate proportional to the pressure increase in cylinder chamber 13.

Figure 4:
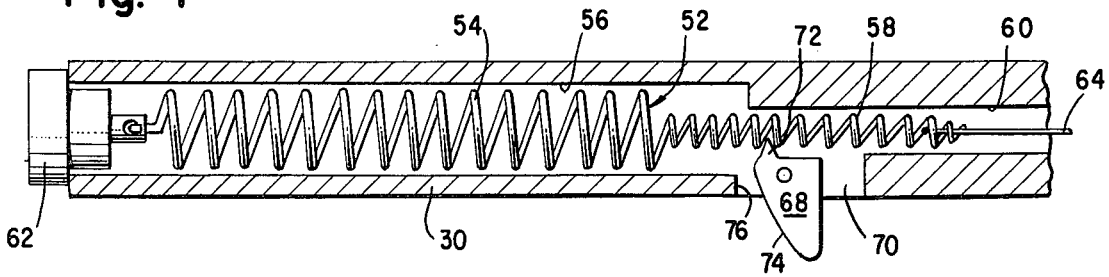
FIG. 4 is an enlarged cross sectional view of the holding mechanism of the invention.
Figure 5:
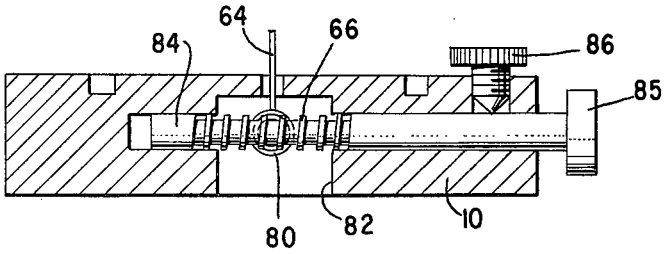
FIG. 5 is an enlarged cross sectional view of the adjustment mechanism of the invention.

In order to provide a more precise control over the flow of the medium a holding mechanism is provided to prevent the return of the control lever which would otherwise occur because of the elasticity of the flexible elastic member 22 and result in an unwanted return flow of the medium and a return flow of air into the nozzle tube member 48. As shown in FIG. 4, the holding mechanism comprises a spring 52 having a first series of large coils 54 disposed in a bore 56 in control lever 30 and a second series of smaller coils 58 disposed in a reduced bore section 60 in control lever 30. The spring 52 is connected to a plug member 62 at its large coil end and a line 64 is connected to spring 52 at its small coil end. The line 64 is connected at its opposite end to a tension adjusting device 66. (FIG. 5) A pivoted braking cam 68 is supported in a slot 70 in control lever 30 and is provided with a spring engaging tooth 72 and a cam surface 74. Tooth 72 has a bevel portion which enables it to disengage from spring 58 when control lever 30 is depressed since this action allows spring 54 to retract and in so doing pulls spring 58 over the bevel of tooth 72. But, when the depressing force on lever 30 is removed, the elasticity of member 22 tends to lift control lever 30 which causes line 64 to pull spring 58 against tooth 72 and causes cam 68 to rotate until face 74 contacts wall 76 of slot 70. This contact prevents any further rotation of cam 68 and tooth 72 locks spring 58 and hence line 64 which then prevents further upward movement of control lever 30 except for the slight amount allowed by the stretch in the coils of spring 58. This limited return movement of the cam and thru the control lever 30 permits a slight negative return pressure in the cylinder 12 and tube 18 so as to slightly suck the medium back into the nozzle member 42 and therefore prevent drippage or unwanted continued flow of the medium. It is known that, with all other factors being equal, the number of coils in a spring determines the tensional value of the spring and as the number of coils decreases, tensional value increases. Therefore, when elastic tension in the elastic member 22 increases upon depressing control lever 30, the number of effective coils in spring 58 decreases so that the opposing tensions in spring 58 and the elastic member 72 are always in balance with each other regardless of where the control arm is stopped.

However, since there will be variations in the material and manufacture of the spring 58 and elastic member 22, an adjusting mechanism 66 is provided to maintain the required balance. As illustrated, line 64 is connected at one end to spring 58 and passes over a roller 78 and is connected at its other end to a rotatable drum 80 around which the line 64 is wound. The drum 80, which is rotatably mounted in a cut-out 82 in base 10, will upon rotation of knob 85 lengthen or shorten line 64 and consequently vary the number of effective coils in spring 58 and thus the tension in the effective portion of spring 58. A locking screw 86 is also provided to prevent unwanted rotation of the drum 80 by frictional engagement therewith after the proper adjustment is made. Thus, the tension in the spring 58 can be adjusted at the outset to balance the tension in the elastic membrane 22 or provide an imbalance, whichever is necessary to achieve the limited return of control lever 30 and to accommodate the differences in characteristics of the medium to be forced through nozzle 42 so that the propper flow will be issued for a particular medium.

The operation of the apparatus of the invention is as follows. The artist after selecting the desired viscose medium for the particular work at hand removes the stopper 40 from the nozzle cylinder 36 and selects a nozzle 42 having a diameter for the lineament desired to be deposited. This nozzle 42 is then inserted in the bore in the stopper 40. The flexible tube 48 is then snapped off of the stopper 40 and filled with the selected medium, snapped back on the stopper and the stopper and filled tube are pressed into cylinder 36. The flow of the medium is then tested by depressing control lever 30 and then releasing it. If return flow into nozzle 42 is too great, an adjustment is made by unwinding line 64 which reduces the number of effective coils in spring 58 which thereby increases the tension therein and in turn offsets the apparent excess tension in membrane 22. If upon release of control lever 30, the medium continues to flow then by means of the adjusting elements, line 64 is wound on drum 80 which increases the number of effective coils in spring 58 thereby reducing the tension therein until it is properly apportioned to tension in membrane 22. Cam 68 is manually rotated to disengage tooth 72 to accomplish this latter adjustment. After the adjustments are properly made, the device is ready for opertion. The artist then presses down on control lever 30 with one hand while holding the nozzle device with the other hand which because of the flexible tubing 18 and the freedom of the hand holding the nozzle, he can direct the flow of medium solely in accordance with his ability without concerning himself that his working hand must also account for the control of the flow of the medium.

If in the execution of laying down a lineament the operator chooses to terminate the lineament he merely releases pressure on control lever 30 and the tension in membrane 22 causes a slight return flow of the medium into the aperture of nozzle 42 thereby nipping off any further flow of the medium. To resume the laying down of a lineament he merely re-applies pressure to control lever 30 and the medium will again immediately flow since it is always "at the ready" in the aperture of nozzle 42. The manual operation of the cam is used essentially in the initial adjustment of the device and in those instances where free movement of control lever 30 is preferred.

As will be seen in reference to FIG. 6 wherein there is illustrated a ceramic vase, the device of the invention is capable of depositing fine controlled lines of lineament on the surface thereof. It will be appreciated the various types of ornamentation can be added to the surface of the base member only being limited by the capability of the artist. After the depositing of the lineament the vase will be finished in the usual manner as by firing, etc.

It will be seen from the above description that applicant has invented a noval and an improved calligraphic device which may conveniently be used by artists or the like for the depositing of lineament in the fields of painting, ceramics, rubber stamps, adhesive application, printing plates, etching, etc. The apparatus is capable of depositing many and varied viscose materials in a controlled manner thus making it a very versatile tool. For example, in ceramics, fine lines of clay lineament may be deposited on a main body such as a cup or bowl which when fired become an integral part of the main body. The apparatus of the invention has the desirable feature of mechanical advantage which enables the artist to work freely and relative unconcerned with the nozzle in his working hand without being preoccupied with the forces required to extrude the working medium. The device is simple in construction, relatively inexpensive to produce and produces very desirble results in operation.

What is claimed is:

1. A calligraphic device comprising nozzle means for depositing a lineament on a surface including fluid pressure responsive means for feeding a viscose medium through said nozzle means, operator influenced manually operable fluid pressure means disposed apart from said nozzle means for providing an operator controlled fluid pressure to said fluid responsive means such that the lineament can be deposited remote from the provision of the fluid pressure means, said fluid pressure means including a cylinder sealed at one end thereof and open at its other end, a piston disposed within said cylinder, a flexible diaphragm disposed within said cylinder intermediate of said cylinder and said piston and in removeable sealing engagement at the open end of said cylinder and means at said closed end of said cylinder and intermediate of said flexible diaphragm and the inner wall of said cylinder for supplying fluid pressure from said fluid pressure means to said nozzle means.

2. A calligraphic device as recited in claim 1 further comprising a manually operable control lever connected to said piston for raising and lowering said piston in said cylinder for controlling the fluid pressure therein.

3. A calligraphic device as recited in claim 2 wherein said manually operable control lever includes holding means for retaining said control lever in selected positions.

4. A calligraphic device as recited in claim 3 wherein said fluid pressure means and said manually operable control lever are supported on a base member.

5. A calligraphic device as recited in claim 4 wherein said manually operable control lever is pivotally supported at one end thereof and pivotally connected to said piston intermediate of its ends.

6. A calligraphic device as recited in claim 3 wherein said holding means includes spring means fixedly connected to said manually operable control lever at one end thereof, braking cam means pivotally connected to said manually operable control lever and operably connected to said spring means for selective engagement therewith and said spring means being operably connected to a fixed member at its other end for permitting expansion and contraction thereof whereby upon disengagement of said braking cam from said spring means said spring means can expand or contract in response to movement of said manually operable control lever and upon engagement of said braking cam with said spring means said manually operable control lever will be held in a selected position.

* * * * *